US006274066B1

(12) United States Patent
Easter

(10) Patent No.: US 6,274,066 B1
(45) Date of Patent: Aug. 14, 2001

(54) LOW ADHESION SEMI-CONDUCTIVE ELECTRICAL SHIELDS

(75) Inventor: Mark R. Easter, Indianapolis, IN (US)

(73) Assignee: General Cable Technologies Corporation, Highland Heights, KY (US)

( * ) Notice: Subject to any disclaimer, the term of this patent is extended or adjusted under 35 U.S.C. 154(b) by 0 days.

(21) Appl. No.: 09/685,574

(22) Filed: Oct. 11, 2000

(51) Int. Cl.[7] ..... H01B 1/24; H01B 7/00

(52) U.S. Cl. ..... 252/511; 174/102 SC; 174/105 SC; 524/495

(58) Field of Search ..... 252/511; 524/495; 174/105 SC, 102 SC; 264/105

(56) References Cited

U.S. PATENT DOCUMENTS

| | | | | |
|---|---|---|---|---|
| 3,182,101 | * | 5/1965 | Rees et al. | 260/885 |
| 4,102,855 | * | 7/1978 | Kuan et al. | 260/42.33 |
| 4,150,193 | | 4/1979 | Burns, Jr. . | |
| 4,226,823 | | 10/1980 | Jansson et al. . | |
| 4,246,023 | | 1/1981 | Savov et al. . | |
| 4,246,142 | | 1/1981 | Ongchin . | |
| 4,412,938 | | 11/1983 | Kakizaki et al. . | |
| 4,493,787 | | 1/1985 | Taniguchi et al. . | |
| 4,648,986 | | 3/1987 | Kotani et al. . | |
| 4,933,107 | * | 6/1990 | Watanabe et al. | 252/511 |
| 4,993,107 | | 2/1991 | Zoni . | |
| 6,086,792 | * | 7/2000 | Reid et al. | 252/511 |
| 6,133,367 | * | 10/2000 | Arhart | 524/515 |

FOREIGN PATENT DOCUMENTS

| | | |
|---|---|---|
| 0 210 425 A2 | 4/1987 | (EP) . |
| 0 420 271 B1 | 9/1990 | (EP) . |
| 60-260637 | 12/1985 | (JP) . |

OTHER PUBLICATIONS

WO 98/21278 International Search Report.

* cited by examiner

*Primary Examiner*—Mark Kopec
(74) *Attorney, Agent, or Firm*—Blank Rome Comisky & McCauley LLP

(57) ABSTRACT

A low adhesion semiconductive dielectric shield for use with cross-linked polyethylene, ethylene-propylene rubber or ethylene-propylene-diene rubber (EPDM rubber) insulation. The dielectric shield comprises a base polymer which is a copolymer of ethylene with a mono-unsaturated ester; a conductive filler in an amount sufficient to give an electrical resistivity below 550 ohms-meter and as an adhesion adjusting device an ethylene vinyl acetate, ethylene alkyl acrylate or ethylene alkyl methacrylate copolymer having a molecular weight above 20,000 daltons and a polydispersity greater than 2.5 wherein the adhesion between the insulation and the semiconductive shield is between about 3–26 lbs per ½ inch.

38 Claims, 1 Drawing Sheet

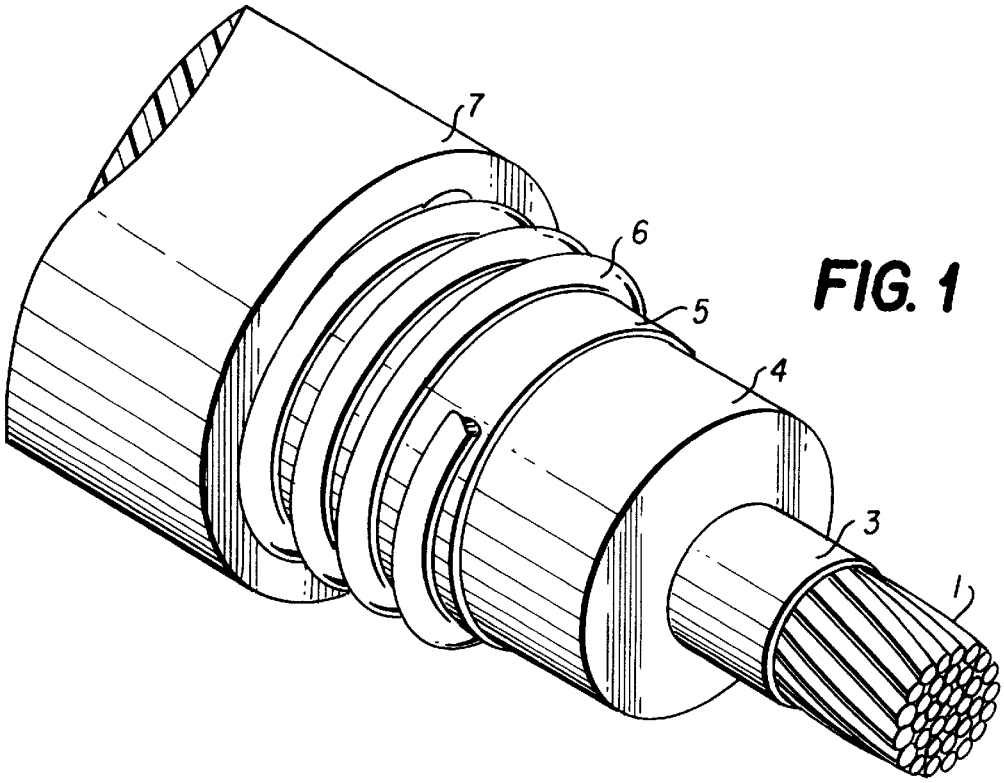
FIG. 1
FIG. 2
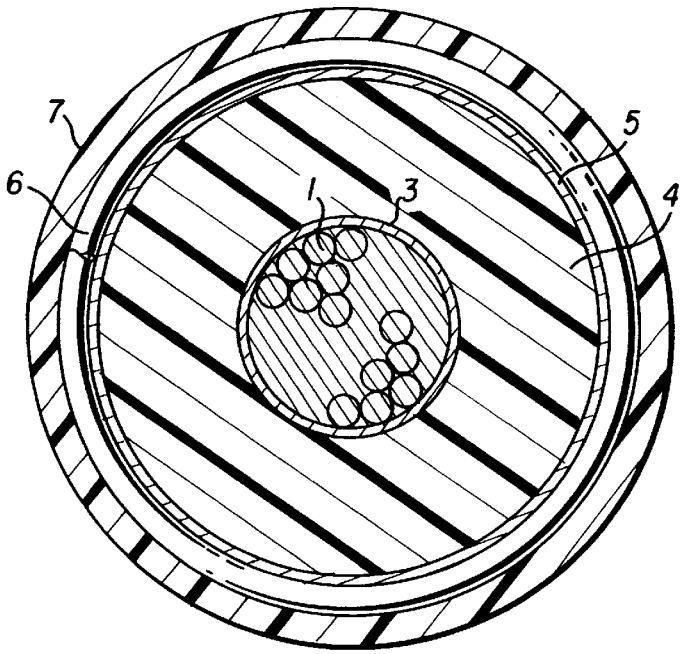

LOW ADHESION SEMI-CONDUCTIVE ELECTRICAL SHIELDS

FIELD OF INVENTION

The invention relates to polymer compositions and the use of these polymer compositions to manufacture semiconductive shields for use in electric cables, electric cables made from these compositions and methods of making electric cables from these compositions. More particularly, the invention relates to composition for use as strippable "semi-conducting" dielectric shields (also referred to as the core shields, dielectric screen and core screen materials in power cables with cross linked polymeric insulation, primarily with medium voltage cables having a voltage from about 5 kV up to about 100 kV.

BACKGROUND OF THE INVENTION

In general, semiconducting dielectric shields can be classified into two distinct types, the first type being a type wherein the dielectric shield is securely bonded to the polymeric insulation so that stripping the dielectric shield is only possible by using a cutting tool that removes the dielectric shield alone with some of the cable insulation. This type of dielectric shield is preferred by companies that believe that this adhesion minimizes the risk of electric breakdown at the interface of the shield and insulation. The second type of dielectric shield is the "strippable" dielectric shield wherein the dielectric shield has a defined, limited, adhesion to the insulation so that the strippable shield can be peeled cleanly away from the insulation without removing any insulation. Current strippable shield compositions for use over insulation selected from polyethylene, cross-linked polyethylenes, or one of the ethylene copolymer rubbers such as ethylene-propylene rubber (EPR) or ethylene-propylene diene terpolymer (EPDM) are usually based on an ethylene-vinyl acetate (EVA) copolymer base resin rendered conductive with an appropriate type and amount of carbon black. The peel characterization of the strippable shield can be obtained by the proper selection of the EVA with a sufficient vinyl acetate content, usually about 32–40% vinyl acetate, and usually with a nitrile rubber as an adhesion-adjusting additive.

Strippable shield formulations of EVA and nitrile rubbers have been described by Ongchin, U.S. Pat. Nos. 4,286,023 and 4,246,142; Burns et al. EP Application No. 0,420,271B, Kakizaki et al U.S. Pat. No. 4,412,938 and Janssun, U.S. Pat. No. 4,226,823, each reference being herein incorporated by reference into this application. A problem with these strippable shield formulations of EVA and nitrile rubber is that the EVA's needed for this formulation have a relatively high vinyl acetate content to achieve the desired adhesion level with the result that the formulations are more rubbery then is desired for high speed extrusion of a commercial electric cable.

Alternative adhesion-adjusting additives have also been proposed for use with EVA, for example waxy aliphatic hydrocarbons (Watanabe et al. U.S. Pat. No. 4,933,107, herein incorporated by reference); low-molecular weight polyethylene (Burns Jr., U.S. Pat. No. 4,150,193 herein incorporated by reference); silicone oils, rubbers and block copolymers that are liquid at room temperature (Taniguchi et al. U.S. Pat. No. 4,493,787 herein incorporated by reference); chlorosulfonated polyethylene, ethylene-propylene rubbers, polychloroprene, styrene-butadiene rubber, natural rubber (all in Janssun) but the only one that appears to have found commercial acceptance was paraffin waxes.

BRIEF DESCRIPTION OF THE FIGURES

FIG. 1 is a cross-sectional representation of the electrical cable of the invention.

FIG. 2 is a perspective view of the electrical cable of the invention.

BRIEF DESCRIPTION OF THE INVENTION

This invention is based on the unexpected discovery that EVA waxes, ethylene alkyl acrylates or ethylene alkyl methacrylate copolymer waxes with a molecular weight greater than 20,000 and a polydispersity greater than 2 were good adhesion modifiers when used with a strippable semiconductive shield base resin and a conventional insulator. The strippable semiconductive shield base resin can include ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ternary copolymers of ethylene with alkyl acrylates and alkyl methacrylates. The strippable semiconductive shield can include any suitable conductive carbon black in an amount to give the semiconductive shield an electrical resistance less than about 550 ohm-meter.

The invention includes electrical cables made using the strippable semiconductive shield of the invention as well as methods of making these electrical cables. The electrical cable of the invention include a conductive core surrounded by a semi-conductive layer that is surrounded by an insulating layer, the insulation of the insulating layer is selected from polyethylene, cross linked polyethylene (XLPE), ethylene-propylene rubbers and ethylene propylene diene rubbers (EPDM rubbers). The insulating layer is covered by the semiconductive dielectric shield of the invention and the semiconductive shield maybe covered by metal wires or strips that are then grounded upon installation of the cable and jacketing

DETAILED DESCRIPTION OF THE INVENTION

This invention includes strippable semiconductive shields suitable for use with conventional electrical insulators, electric power cables employing these strippable semiconductive dielectric shields and methods of making both the semiconductive shields and electric power cables employing these shields.

Conventional electrical insulators used in medium voltage cables include polyethylenes, cross-linked polyethylenes (XLPE), ethylene-propylene rubbers and ethylene propylene diene rubbers (EPDM rubbers). The term polyethylene is meant to include both polymers and copolymers wherein ethylene is the major component, this would include, for example metallocene or single site catalyzed ethylenes that are copolymerized with higher olefins.

The strippable semiconductive shields of the invention comprise base resins, adhesion modifying compounds and conductive carbon blacks. The conductive carbon blacks are added in an amount sufficient to decrease the electrical resistivity to less than 550 ohm-meter. Preferably the resistivity of the semiconductive shield is less than about 250 ohm-meter and even more preferably less than about 100 ohm-meter.

The base resin is selected from any suitable member of the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ternary copolymers of ethylene, alkyl acrylates and alkyl methacrylate wherein the alkyl group is independently selected from C1 to C6 hydrocarbons.

The ethylene vinyl acetate copolymer base resin can be any EVA copolymer with the following properties: the ability to accept high loadings of conductive carbon filler, elongation of 150 to 250 percent and sufficient melt strength to maintain its shape after extrusion. EVA copolymers with vinyl acetate levels above about 25 percent and below about 45 percent having these properties are known. The EVA copolymers can have a vinyl acetate percentage range of about 25 to 45 percent. A preferred EVA copolymer will have a vinyl acetate percentage range of about 28 to 40 percent and an even more preferred EVA copolymer will have a vinyl acetate percentage of about 28 to 33 percent. The EVA copolymers can have a molecular weight from about 40,000 to 150,000 daltons preferably about 45,000 to 100,000 daltons and even more preferably about 50,000 to 75,000 daltons. Examples of suitable EVA copolymers would include Elvax® 150, Elvax® 240 and Elvax® 350, sold by DuPont Corp. of Wilmington Del.

The ethylene alkyl acrylate copolymers can be any suitable ethylene alkyl acrylate copolymers with the following properties: the ability to accept high loadings of conductive carbon filler, elongation of 150 to 250 percent and sufficient melt strength to maintain its shape after extrusion. The alkyl group can be any alkyl group selected from the C1 to C6 hydrocarbons, preferably the C1 to C4 hydrocarbons and even more preferable methyl. Some ethylene alkyl acrylate copolymers with alkyl acrylate levels above about 25 percent and below about 45 percent have these properties. The ethylene alkyl acrylate copolymers can have an alkyl acrylate percentage range of about 25 to 45 percent. A preferred ethylene alkyl acrylate copolymer will have an alkyl acrylate percentage range of about 28 to 40 percent and an even more preferred ethylene alkyl acrylate copolymer will have an alkyl acrylate percentage of about 28 to 33 percent. The ethylene alkyl acrylate copolymers can have a molecular weight from about 40,000 to 150,000 daltons preferably about 45,000 to 100,000 daltons and even more preferably about 50,000 to 75,000 daltons. An example would be Vamac® G or Vamac® HG sold by DuPont Corp. of Wilmington, Del.

The ethylene alkyl methacrylate copolymers can be any suitable ethylene alkyl methacrylate copolymer with the following properties: the ability to accept high loadings of conductive carbon filler, elongation of 150 to 250 percent and sufficient melt strength to maintain its shape after extrusion. The alkyl group can be any alkyl group selected from the C1 to C6 hydrocarbons, preferably the C1 to C4 hydrocarbons and even more preferable methyl. Some ethylene alkyl methacrylate copolymers with alkyl methacrylate levels above about 25 percent and below about 45 percent have these properties. The ethylene alkyl methacrylate copolymers can have an alkyl methacrylate percentage range of about 25 to 45 percent. A preferred ethylene alkyl methacrylate copolymer will have an alkyl methacrylate percentage range of about 28 to 40 percent and an even more preferred ethylene alkyl methacrylate copolymer will have an alkyl methacrylate percentage of about 28 to 33 percent. The ethylene alkyl methacrylate copolymers can have a molecular weight from about 40,000 to 150,000 daltons preferably about 45,000 to 100,000 daltons and even more preferably about 50,000 to 75,000 daltons. An example of a commercially available ethylene methyl methacrylate is 35MA05 from Atofina of Paris -La Defence, France.

The ternary copolymers of ethylene with alkyl acrylates and alkyl methacrylates can be any suitable ternary copolymer with the following properties: the ability to accept high loadings of conductive carbon filler, elongation of 150 to 250 percent and sufficient melt strength to maintain its shape after extrusion. The alkyl group can be any alkyl group independently selected from the C1 to C6 hydrocarbons, preferably the C1 to C4 hydrocarbons and even more preferable methyl. Usually a ternary copolymer will be predominantly either an alkyl acrylate with a small portion of an alkyl methacrylate or an alkyl methacrylate with a small portion of an alkyl acrylate. The proportions of alkyl acrylate and alkyl methacrylate to ethylene will be about the same as the proportions described for ethylene alkyl acrylate copolymers or for ethylene alkyl methacrylate copolymers as well as the molecular weight ranges described for ethylene alkyl acrylate and ethylene alkyl methacrylate.

The adhesion modifying compounds are any suitable ethylene vinyl acetate copolymers with a molecular weight greater than about 20,000 daltons, a preferred ethylene vinyl acetate copolymer will have a molecular weight from about 22,500 to about 50,000 daltons and an even more preferred EVA copolymer will have a molecular weight from about 25,000 to about 40,000 daltons. The adhesion modifying ethylene vinyl acetate copolymers of the invention will have a polydispersivity greater than about 2.5 preferably a polydispersivity greater than 4 and even more preferably a polydispersivity greater than 5. Polydispersity is $M_W$ divided by $M_n$ and is a measure of the distribution of the molecular weights of the polymer chains. The proportion of vinyl acetate in the adhesion modifying ethylene vinyl acetate copolymers of the invention should be about 10 to 28 percent, preferably about 12 to 25 and even more preferably about 12 to 20 percent vinyl acetate. Suitable commercially available material includes AC 415, a 15 percent vinyl acetate wax available from Honeywell Inc. of Morristown, N.J.

The adhesion modifying compounds can also include any suitable ethylene alkyl acrylate or ethylene alkyl methacrylate copolymer wherein the alkyl group is selected from the C1 to C6 hydrocarbons and with a molecular weight greater than about 20,000 daltons, a preferred ethylene alkyl acrylate or ethylene alkyl methacrylate copolymer will have a molecular weight from about 22,500 to about 50,000 daltons and an even more preferred ethylene alkyl acrylate or ethylene alkyl methacrylate copolymer will have a molecular weight from about 25,000 to about 40,000 daltons. The adhesion modifying ethylene alkyl acrylate or ethylene alkyl methacrylate copolymers of the invention will have a polydispersivity greater than about 2.5 preferably a polydispersivity greater than 4 and even more preferably a polydispersivity greater than 5. Polydispersity, as previously defined, is $M_W$ divided by $M_n$ and is a measure of the distribution of the molecular weights of the polymer chains. The proportion of alkyl acrylate or alkyl methacrylate in the adhesion modifying ethylene alkyl acrylate or ethylene alkyl methacrylate copolymers of the invention should be about 10 to 28 percent, preferably about 12 to 25 and even more preferably about 12 to 20 percent alkyl acrylate. The alkyl group is selected from the C1 to C6 hydrocarbons, preferably the C1 to C4 hydrocarbons and even more preferably methyl.

The conductive carbon black can be any conductive carbon blacks in an amount sufficient to decrease the electrical resistivity to less than 550 ohm-meter. Preferably the resistivity of the semiconductive shield is less than about 250 ohm-meter and even more preferably less than about 100 ohm-meter. Suitable carbon blacks include N351 carbon blacks and N550 carbon blacks sold by Cabot Corp. of Boston Mass.

The strippable semiconductive shield formulations of the invention can be compounded by a commercial mixer such as a Banbury mixer, a twin screw extruder a Buss Ko Neader or other continuous mixers. The proportion of the adhesion modifying compound to the other compounds in the strippable semiconductive shield will vary depending on the base polymer, underlying insulation, molecular weight of the adhesion modifying compound and polydispersity of the adhesion modifying compound. A strippable shield formulation can be made by compounding 30 to 45 percent by weight carbon black with 0.5 to 10 percent by weight adhesion modifying compound, and the balance the base polymer, optionally any one of, the following components may be added 0.05 to 3.0 percent by weight process aid, 0.05 to 3.0 percent by weight antioxident, 0.1 to 3.0 percent by weight cross-linking agent. Another strippable shield formulation can have 33 to 42 percent by weight carbon black, 1.0 to 7.5 weight percent adhesion modifying compound and the balance base polymer optionally any one of, the following components may be added: 0.1 to 2.0 percent by weight process aid, 0.1 to 2.0 percent by weight antioxident, 0.5 to 2.0 percent by weight cross-linking agent. Still another strippable shield formulation can have 35 to 40 percent by weight carbon black, 2.0 to 7.0 percent by weight adhesion modifying compound, and the balance base polymer optionally any one of, the following components may be added: 0.25 to 1.5 percent by weight process aid, 0.25 to 1.5 percent by weight antioxident, 1.0 to 2.0 percent by weight cross-linking agent. TIhe strippable shield formulation can be compounded by mixing the carbon black, adhesion modifying compound, processing aid, anti-oxident and base polymer together in a continuous mixer until well mixed and then the cross linking agent may be added in a second mixing step or absorbed into the polymer mass after mixing. After addition of the cross-linking agent the formulation is ready to be extruded onto the insulation and cross-linked to form the strippable semiconductive shield.

The cross linking agent can be chosen from any of the well know cross-linking agents known in the art including silanes that are cross-linked by moisture and peroxides that form free radicals and cross-link by a free radical mechanism.

The invention includes electrical cables made using the strippable semiconductive shield of the invention as well as methods of making these electrical cables. As seen in FIGS. 1 and 2, the electrical cable of the invention includes a conductive core (1) surrounded by a semi-conductive layer (3) that is surrounded by an insulating layer (4), the insulation of the insulating layer is selected from polyethylene, cross linked polyethylene (XLPE), ethylene-propylene rubbers and ethylene propylene diene rubbers (EPDM rubbers). The insulating layer (4) is covered by the semiconductive dielectric shield (5) of the invention and the semiconductive shield maybe covered by metal wires or strips (6) that are then grounded upon installation of the cable and jacketing (7).

The electrical cable of the invention can be made by any of the methods well known in the art including coating a metal conductor with a semi-conductive layer and in a double extrusion crosshead extruding the insulating layer and the strippable semi-conductive shield together in a simultaneous extrusion or simultaneously extruding a semi-conductive layer around a metal conductor, an insulating layer around the semiconductive layer and a strippable semiconductive shield around the insulating layer by using a triple extrusion crosshead. The semiconductive shield, insulating layer and strippable semiconductive shield may then be allowed to internally cross-link if desired. Metal wires or strips are then wrapped around the cable and a jacket is placed over the metal wire or strips to form a finished cable.

EXAMPLES

The compositions tabulated below were made up by the procedure set out after the table, and made up into moulded plaques measuring 150 mm square by 2 mm thick, one face being plaques measuring 150 mm square by 2 mm thick, one face being bonded to an XLPE block of the same dimensions and the two compositions cured together in the press for 20 min at 180° C. Selected compositions only were made up in large quantities by a similar procedure in a Buss Ko Neader continuous compounding extruder and dual-extruded under standard commercial conditions for the respective materials onto sample cables with either XLPE or EPR insulation having an external diameter of 20 mm to form a dielectric screen 1.0 mm thick. In each case adhesion was measured by the peel strength tests detailed below. Identification of ingredients also follows after the Table. In the table, numbered Examples are in accordance with the invention; lettered Examples are for comparison. Each Example was also formulated with 0.8 weight percent processing aid (zinc stearate), 0.5 weight percent anti-oxidant (polymerized 1,2 dihydro -2, 2, 4 trimethyl quinoline, Agerite Ma., from R. T. Vanderbilt ) and 1.5 weight percent cross-linking agent (tert-butyl cumyl peroxide).

TABLE 1

| | | | EVA with 40% Vinyl Acetate | | | | | | |
|---|---|---|---|---|---|---|---|---|---|
| Example | A | B | 1 | 2 | 3 | 4 | 5 | 6 | 7 |
| Base Polymer | EVA 40 | EVA 40 | EVA 40 | EVA 40 | EVA 40 | EVA 40 | EVA 40 | EVA 40 | EVA 40 |
| (Parts) | 60.5 | 56.7 | 56.7 | 56.7 | 56.7 | 59.7 | 58.7 | 60.7 | 57.7 |
| Adhesion Modifier | — | AC 400 | AMC[2] 67 | AMC[2] 67 | AMC[2] 70 | AMC[2] 91 | AMC[2] 91 | AMC[2] 67 | AMC[2] 67 |
| (% Vinyl Acetate) | | (13%) | (16%) | (16%) | (20%) | (13%) | (13%) | (14%) | (14%) |
| Parts | — | (5) | (5) | (5) | (5) | (2) | (3) | (1) | (4) |
| Adhesion | 12.0 | 9.9 | 8 | 6.5 | 6.5 | 7.1 | 7 | 8.7 | 8.1 |

[1]The MW of Ac400 is less than 20,000 Daltons.

[2]AMC stands for "adhesion modifying compound" and these compounds are ethylene vinyl acetate waxes with the vinyl acetate content indicated with a range of molecular weights greater than 20.000 daltons and with a range of polydispersivitys greater than 2.5

TABLE 2

| | EVA with 32% Vinyl Acetate | | | | | | | | |
|---|---|---|---|---|---|---|---|---|---|
| Example | C | D | E | 6 | 7 | 8 | 9 | 10 | 11 |
| Base Polymer | EVA 32 | EVA 32 | EVA 32 | EVA 32 | EVA 32 | EVA 32 | EVA 40 | EVA 56.7 | EVA 57.7 |
| (Parts) | 60.3 | 56.7 | 56.7 | 56.7 | 56.7 | 56.7 | 58.7 | 56.7 | 57.7 |
| Adhesion Modifier (% Vinyl Acetate) | — | AC 400[1] (13%) | AC 400[1] (13%) | AMC[2] 66 (12%) | AMC[2] 67 (14%) | AMC[2] 68 (16%) | AMC[2] 69 (18%) | AMC[2] 70 (20%) | AMC[2] 37 (14%) |
| Parts | — | (5) | (5) | (5) | (5) | (2) | (3) | (1) | (4) |
| Carbon Type | N 351 | N 351 | N 550 | N 351 | N 351 | N 381 | N 351 | N 351 | N 351 |
| Parts | 37 | 37 | 37 | 37 | 37 | 37 | 37 | 37 | 37 |
| Adhesion | 19 | 12–13.3 | 8.9 | 11.1 | 7.7 | 7.9 | 8.2 | 9.9 | 8.1 |

[1]The MW of Ac400 is less than 20,000 Daltons.
[2]AMC stands for "adhesion modifying compound" and these compounds are ethylene vinyl acetate waxes with the vinyl acetate content indicated with a range of molecular weights greater than 20.000 daltons and with a range of polydispersivitys greater than 2.5.

TABLE 3

| | EVA with 28% Vinyl Acetate | | | | |
|---|---|---|---|---|---|
| Example | F | G | H | 12 | 13 |
| Base Polymer | EVA 28 | EVA 28 | EVA 28 | EVA 28 | EVA 28 |
| (Parts) | 60.3 | 56.7 | 58.75 | 56.7 | 56.7 |
| Adhesion Modifier (% Vinyl Acetate) | — | AC 400[1] (13%) | AC 415[3] | AMC[2] 67 (14%) | AMX[2] 69 (16%) |
| Parts | — | 5 | 3 | 5 | 5 |
| Carbon Type | N315 | N351 | N351 | N351 | N550 |
| Parts | 37 | 37 | 37 | 37 | 37 |
| Adhesion | 30 | 14 | 13.2 | 11.3 | 10.0 |

[1]The MW of Ac400 is less than 20,000 Daltons and the polydispersity is less than 2.
[2]AMC stands for "adhesion modifying compound" and these compounds are ethylene vinyl acetate waxes with the vinyl acetate content indicated with a range of molecular weights greater than 20.000 daltons and with a range of polydispersivitys greater than 2.5.
[3]The MW of AC415 is greater than 20,000 and the polydispersivity is greater than 2.5.

TABLE 4

| | EVA with a Vinyl Acetate content of 25% | | | | |
|---|---|---|---|---|---|
| Example | I | J | 14 | 15 | 16 |
| Base Polymer | EVA 25 | EVA 25 | EVA 25 | EVA 25 | EVA 25 |
| (Parts) | 60.2 | 56.7 | 56.7 | 56.7 | 56.7 |
| Adhesion Modifier (% Vinyl Acetate) | — | AC 400[1] (13%) | AMC[2] 66 (12%) | AMC[2] 68 (5%) | AMC[2] 70 (20%) |
| Parts | — | 5 | 2 | 3 | 1 |
| Carbon Type | N351 | N550 | N550 | N550 | N550 |
| Parts | 37 | 37 | 37 | 37 | 37 |
| Adhesion | Bonded | 15.1 | 19. | 11.8 | 15.5 |

[1]The MW of Ac400 is less than 20,000 Daltons and the polydispersity is less than 2.
[2]AMC stands for "adhesion modifying compound" and these compounds are ethylene vinyl acetate waxes with the vinyl acetate content indicated with a range of molecular weights greater than 20.000 daltons and with a range of polydispersivitys greater than 2.5.

| Example | K | 17 | 18 |
|---|---|---|---|
| Base Polymer | EVA34 | EVA32 | EVA32 |
| (Parts) | 56.7 | 56.7 | 56.7 |
| Adhesion Modifer (% Vinyl Acetate) | AC 400[1] (13%) | AC 415[2] (14–16%) Sample 1 | AC 415[2] (14–16%) Sample 2 |
| Parts | 5 | 5 | 5 |
| CarbonType | N351 | N351 | N351 |
| Parts | 37 | 37 | 37 |
| Adhesion on Plaque | 12 | 10 | 11 |
| Adhesion on Cable | 14–18 lb | 9–10 | 12–14 |

[1]The MW of Ac400 is less than 20,000 Daltons and the polydispersity is less than 2.
[2]The MW of AC415 is greater than 20,000 and the polydispersivity is greater than 2.5.

Mixing Procedure

Batches of about 1350 g (3.31b) of each composition were made up using a Farrell model BR Banbury mixer with a capacity of 1.57 1. Half the base polymer and half the adhesion-adjusting additive were first introduced into the cold Banbury and fluxed at its middle speed setting; the processing aid and antioxidant were added together, followed immediately by the carbon black. The ram was lowered and raised and the remainder of the base polymer and adhesion-adjusting additive were added and blending continued until the temperature reached 135° C. (275° F.). The material was discharged and cooled to ambient temperature, and then half of it reintroduced to the cold Banbury, fluxed and the peroxide added, followed immediately by the remainder of the mixture, blending was continued until the temperature reached 110° C. (230° F.) and the mixture discharged and promptly moulded.

Ingredients:

EVA 34: ethylene-vinyl acetate copolymer, 34% vinyl acetate content, 43 melt index, sold under the trademark ELVAX as Elvax EP4174 by the Dupont Corp.

EVA 32: ethylene-vinyl acetate copolymer, 32% vinyl acetate content, 43 melt index, sold under the Trademark ELVAX as Elvax 150 by the Dupont Corp.

EVA 40: ethylene-vinyl acetate copolymer, 40% vinyl acetate content, 57 melt index, sold under the trademark ELVAX as Elvax 40W by the Dupont Corp.

EVA 28: ethylene-vinyl acetate copolymer, 28% vinyl acetate content, 43 melt index, sold under the trademark Elvax as Elvax 240 by the Dupont Corp.

EVA 25: ethylene-vinyl acetate copolymer, 25% vinyl acetate content, 19 melt index, sold under the trademark Elvax as Elvax 350 by the Dupont Corp.

AC400: ethylene-vinyl acetate copolymer of molecular weight about 17,934 Daltons, 13% vinyl acetate content, polydispensivity of 1.9, 92° C. (198° F.) Mettler drop point, sold by Allied Signal under this designation.

AC 415 is an ethylene vinyl acetate wax with 14–16 percent vinyl acetate, a molecular weight of 22,500–50,000 daltons and a polydispersivity of 2.5–10.

AMC stands for "adhesion modifying compound" and these compounds are various experimental EVA waxes with the vinyl acetate composition indicated in the tables and a range of molecular weights greater than 20,000 daltons and with a range of polydispersivity greater than 2.5.

N351 carbon black and N550 carbon black as described in ASTM D 1765-98B, are conductive carbon blacks obtained from Cabot Corp. of Boston Mass.

Adhesion tests

Plaque samples were tested by cutting completely through the thickness of the layer of the experimental shield composition in parallel lines to define a strip 12.5 m (½ inch) wide; one end was lifted and turned back 180° to lie along the surface of the portion still adhered, and the force required to peel at a rate of 0.0085 m/s (20 in/min) measured; peel strength was calculated in N/m and pounds per ½ inch.

Cable samples were tested generally in the same way, with the cuts parallel to the cable axis, but the peeling force was applied an measured in a direction at 90° to the surface, instead of 180°. Because of the different preparation and crosslinking methods used in preparing plaques compared to extruding cable as well as this difference in pulling direction, plaque and cable peel strengths are not directly comparable but plaque tests do provide a useful guide in the development process: typically cable peel force is measured at a 90 degree angle with the cable will prove to be roughly twice the plaque peel force which is measured at a 180 degree angle which is also called "T peel."

What is claimed is:

1. A strippable semiconductive shield comprising, a base polymer selected from the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons;

an adhesion modifying compound different from said base polymer comprising an ethylene vinyl acetate with a molecular weight greater than about 20,000 daltons and a polydispersivity greater than about 2.5;

a conductive carbon black in an amount sufficient to give the semiconductive shield a resistance below about 550 ohm-meter.

2. The strippable semiconductive shield of claim 1 wherein the base polymer is ethylene vinyl acetate copolymers.

3. The strippable semiconductive shield of claim 1 wherein the base polymer is ethylene alkyl acrylate copolymers wherein the alkyl group is selected from C1 to C6 hydrocarbons.

4. The strippable semiconductive shield of claim 1 wherein the base polymer is ethylene alkyl methacrylate copolymers wherein the alkyl group is selected from C1 to C6 hydrocarbons.

5. The strippable semiconductive shield of claim 1 wherein the base polymer is ethylene alkyl acrylate alkyl methacrylate terpolymers wherein the alkyl group is independently selected from C1 to C6 hydrocarbons.

6. The strippable semiconductive shield of claim 1 wherein the adhesion modifying compound comprises an ethylene vinyl acetate with a molecular weight from about 22,500 to about 50,000 daltons.

7. The strippable semiconductive shield of claim 6 wherein the adhesion modifying ethylene vinyl acetate has a molecular weight from about 25,000 to about 40,000 daltons.

8. The strippable semiconductive shield of claim 1 wherein the adhesion modifying compound comprises an ethylene vinyl acetate with a polydispersivity greater than 4.

9. The strippable semiconductive shield of claim 1 wherein the adhesion modifying compound comprises an ethylene vinyl acetate with a polydispersivity greater than 5.

10. The strippable semiconductive shield of claim 1 wherein the adhesion modifying compound comprises an ethylene vinyl acetate having a vinyl acetate composition between about 10 to 28 percent.

11. The strippable semiconductive shield of claim 10 wherein the adhesion modifying ethylene vinyl acetate has a vinyl acetate composition between about 12 to 25 percent.

12. The strippable semiconductive shield of claim 1 wherein the carbon black is selected from N550 and N351 type carbon blacks.

13. The strippable semiconductive shield of claim 1 wherein the semiconductive shield further includes a cross-linking agent.

14. The strippable semiconductive shield of claim 1 wherein the semiconductive shield comprises 30 to 45 percent by weight carbon black and 0.5 to 10 percent by weight adhesion modifier.

15. The strippable semiconductive shield of claim 1 wherein the semiconductive shield comprises 33 to 42 percent by weight carbon black and 1.0 to 7.5 weight percent adhesion modifying compound.

16. A method of making a strippable semiconductive shield comprising the steps of compounding a base polymer selected from the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons with;

an adhesion modifying compound different from said base polymer comprising an ethylene vinyl acetate with a molecular weight greater than about 20,000 daltons and a polydispersivity greater than about 2.5 and a conductive carbon black in an amount sufficient to give the semiconductive shield a resistance below about 550 ohm-meter together in a mixer to form a mixture and extruding the mixture to form the strippable semiconductive shield.

17. The method of claim 16 further comprising the step of adding a cross-linking agent to the mixture.

18. The method of claim 17 further comprising the step of cross-linking the strippable semiconductive shield.

19. The method of claim 16 wherein the strippable semiconductive shield comprises 30 to 45 weight percent carbon black and 0.5 to 10 weight percent adhesion modifier.

20. The method of claim 16 wherein the strippable semiconductive shield comprises 33 to 42 weight percent carbon black and 1.0 to 7.5 weight percent adhesion modifier.

21. A medium voltage electric power cable comprising a conductive core, and insulating layer, a strippable semiconductive shield, a grounded metal wire or tape and a jacket; wherein said strippable semi-conductive shield comprises, a base polymer selected from the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons;

an adhesion modifying compound different from said base polymer comprising an ethylene vinyl acetate with a molecular weight greater than about 20,000 daltons and a polydispersivity greater than about 2.5;

a conductive carbon black in an amount sufficient to give the semiconductive shield a resistance below about 550 ohm-meter.

22. The power cable of claim 21 wherein the base polymer is ethylene vinyl acetate copolymers.

23. The power cable of claim 21 wherein the base polymer is ethylene alkyl acrylate copolymers wherein the alkyl group is selected from C1 to C6 hydrocarbons.

24. The power cable of claim 21 wherein the base polymer is ethylene alkyl methacrylate copolymers wherein the alkyl group is selected from C1 to C6 hydrocarbons.

25. The power cable of claim 21 wherein the base polymer is ethylene alkyl acrylate alkyl methacrylate terpolymers wherein the alkyl group is independently selected from C1 to C6 hydrocarbons.

26. The power cable of claim 21 wherein the adhesion modifying compound comprises an ethylene vinyl acetate with a molecular weight from about 22,500 to about 50,000 daltons.

27. The power cable of claim 26 wherein the ethylene vinyl acetate has a molecular weight greater than about 25,000 to about 40,000 daltons.

28. TIhe power cable of claim 21 wherein the adhesion modifying compound comprises an ethylene vinyl acetate with a polydispersivity greater than 4.

29. The power cable of claim 21 wherein the adhesion modifying compound comprises an ethylene vinyl acetate with a polydispersivity greater than 5.

30. The power cable of claim 21 wherein the adhesion modifying compound comprises an ethylene vinyl acetate having a vinyl acetate composition between about 10 to 28 percent.

31. The power cable of claim 30 wherein the ethylene vinyl acetate has a vinyl acetate composition between about 12 to 25 percent.

32. The power cable of claim 21 wherein the carbon black is selected from N550 and N351 type carbon blacks.

33. A method of making a medium voltage electric power cable having a strippable semiconductive shield comprising the steps of simultaneously extruding through a triple extrusion crosshead a semiconductive layer encasing a metal conductor, an insulating layer encasing the semiconductive layer and a strippable semiconductive layer encasing the insulating layer, wrapping the strippable semiconductive layer with metal wire or metal strips and placing a jacket over the metal wire or strips, wherein said strippable semiconductive comprises a base polymer selected from the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons;

an adhesion modifying compound different from said base polymer comprising an ethylene vinyl acetate with a molecular weight greater than about 20,000 daltons and a polydispersivity greater than about 2.5;

a conductive carbon black in an amount sufficient to give the semiconductive shield a resistance below about 550 ohm-meter.

34. The method of claim 33 wherein the insulating layer is cross-linked after extrusion.

35. The method of claim 34 wherein the semiconductive shield is cross-linked after extrusion.

36. A method of making a medium voltage electric power cable having a strippable semiconductive shield comprising the steps of simultaneously extruding through a double extrusion crosshead onto a semiconductive layer encasing a metal conductor, an insulating layer encasing the semiconductive layer and a strippable semiconductive layer encasing the insulating layer, wrapping the strippable semiconductive layer with metal wire or metal strips and placing a jacket over the metal wire or strips, wherein said strippable semiconductive comprises a base polymer selected from the group consisting of ethylene vinyl acetate copolymers, ethylene alkyl acrylate copolymers wherein the alkyl group is selected from C1 to C6 hydrocarbons, ethylene alkyl methacrylate copolymers wherein the alkyl group is selected from C1 to C6 hydrocarbons and ethylene alkyl acrylate alkyl methacrylate terpolymers wherein the alkyl group is independently selected from C1 to C6 hydrocarbons;

an adhesion modifying compound different from said base polymer comprising an ethylene vinyl acetate with a molecular weight greater than about 20,000 daltons and a polydispersivity greater than about 2.5;

a conductive carbon black in an amount sufficient to give the semiconductive shield a resistance below about 550 ohm-meter.

37. The method of claim 36 wherein the insulating layer is cross-linked after extrusion.

38. The method of claim 36 wherein the semiconductive shield is cross-linked after extrusion.

* * * * *